United States Patent [19]

Watson et al.

[11] 4,036,642

[45] July 19, 1977

[54] COPPER BASE ALLOY CONTAINING TITANIUM, ANTIMONY AND CHROMIUM

[75] Inventors: W. Gary Watson, Cheshire; John F. Breedis, Trumbull, both of Conn.

[73] Assignee: Olin Corporation, New Haven, Conn.

[21] Appl. No.: 687,671

[22] Filed: May 19, 1976

[51] Int. Cl.[2] ..... C22C 9/00; C21D 1/44

[52] U.S. Cl. ..... 75/164; 75/153; 148/13.2; 148/160

[58] Field of Search ..... 75/153, 164; 148/13.2, 148/160

[56] References Cited

U.S. PATENT DOCUMENTS

| | | | |
|---|---|---|---|
| 2,189,198 | 2/1940 | Comstock | 75/164 |
| 3,773,505 | 11/1973 | Nesslage et al. | 75/164 |
| 4,007,039 | 2/1977 | Shapiro et al. | 75/153 |

*Primary Examiner*—Walter R. Satterfield

*Attorney, Agent, or Firm*—Robert A. Dawson; Robert H. Bachman

[57] ABSTRACT

Copper base alloys which exhibit a combination of high electrical conductivity and superior strength properties are presented. These alloys consist essentially of 0.08 to 1.0% by weight of titanium, 0.05 to 1.5% by weight of antimony, 0.1 to 1.0% by weight of chromium, balance copper. The desired properties are attained by the proper application of mechanical processing steps and thermal treatments.

8 Claims, No Drawings

COPPER BASE ALLOY CONTAINING TITANIUM, ANTIMONY AND CHROMIUM

BACKGROUND OF THE INVENTION

There exists a great need for copper base alloys which possess a combination of high mechanical strength properties with high electrical conductivity properties. Generally, such alloys are utilized for electrical conductor application which require greater tensile strength than that possessed by pure copper in the same applications.

A variety of copper base alloys have been proposed to fill this need for an alloy capable of displaying the combination of high mechanical strength properties and high electrical conductivity. Among these alloys, copper base alloys containing titanium and antimony have been proposed as being capable of maintaining both strength and conductivity properties at high levels. Copper base alloys consisting of copper alloyed with 0.08 to 0.7% by weight of titanium and 0.05 and 1.0% by weight of antimony have been described in U.S. Pat. Nos. 3,773,505 and 3,832,241 to Donald J. Nesslage and Lin S. Yu, as being capable of maintaining moderately high mechanical strength while overcoming undesirably low electrical conductivities.

SUMMARY OF THE INVENTION

The present invention provides for improvements in strength of the copper-titanium-antimony ternary system along with improvements in conductivity over those values obtainable from such systems as disclosed in the Nesslage et al. patents. This improvement is accomplished by the addition of chromium to the cooper-titanium-antimony ternary system. The chromium is added in the amount of 0.1 to 1.0% by weight to the ternary system composed of 0.08 to 1.0% by weight of titanium, 0.05 to 1.5% by weight of antimony with the balance copper.

The addition of chromium to the ternary system permits significantly higher strength properties, albeit at electrical conductivity levels lower than those presented in the Nesslage et al. patents when the resulting quaternary system is processed in accordance with the optimum processing taught in U.S. Pat. Nos. 3,773,505 and 3,832,241. The influence of the chromium addition, when the system is processed according to the present invention, is shown in an increase in strength properties when compared to the alloys of, for example, Nesslage et al., while maintaining an electrical conductivity level fairly equivalent to the alloys presented in the Nesslage et al. references.

Therefore, the main objective of the present invention is to provide a copper base alloy which contains 0.1 to 1.0% by weight of chromium in addition to 0.08 to 1.0% by weight of titanium and 0.05 to 1.5% by weight of antimony, said alloy possessing a unique combination of high strength and high electrical conductivity.

Another object of the present invention is to provide such an alloy as described above which can be processed according to methods already well known in this field.

A further object of the present invention is to provide a process for producing an alloy as described above which results in an increase in strength without a significant reduction in electrical conductivity properties of the alloy.

Other objects and advantageous features of the invention will become more apparent to those skilled in this art from the following detailed description of the preferred compositions and procedures in accordance with the present invention.

DETAILED DESCRIPTION

The present invention requires that copper of adequate purity be alloyed with 0.08 to 1.0% by weight of titanium, 0.05 to 1.5% by weight of antimony and 0.1 to 1.0% by weight of chromium. Between 0.1 and 0.6% by weight of chromium is preferred in the alloy system. It is essential to the properties of the alloy obtained from these elements that the atomic ratio of the titanium to antimony be equal to or close to, but not substantially in excess of, the ratio 5:3. This ratio is critical in that when the alloy compostion is such that the ratio of titanium to antimony substantially exceeds 5:3, for example by 10%, the resulting properties of the alloy are marked by a substantial decrease in the electrical conductivity of the alloy. In contrast, up to 20% excess amounts of antimony cause a relatively slight decrease in the electrical conductivity properties of the alloy. For example, the titanium and antimony may be present in the alloy at an atomic ratio of 3 to 3.6 atoms of antimony per 5 atoms of titanium.

The alloys of this invention may be prepared as molten metal by the conventional operation of known melting equipment, the alloying additions being made by any convenient method, including the use of copper master alloys. The alloy ingots are cast using conventional equipment and techniques.

The combination of optimum strength characteristics and high electrical conductivity is developed in the alloy through a properly coordinated schedule of mechanical operations to reduce the cross-sectional area of the cast ingot or billet. Thermal operations may also be utilized to develop the strength characteristics and high electrical conductivity of the alloy. The mechanical operations include extrusion, forging, wire drawing and preferably a combination of hot and cold rolling. The hot rolling may, by itself, perform a solution annealing function on the worked alloy if the operation is performed at a temperature which is high enough to put the alloying elements into solution. The hot rolling may also be utilized with a separate solution annealing step to place the alloying elements into solution. After either solution annealing step, the alloy is rapidly cooled to maintain the maximum solid solution of all alloying elements. The alloy is then subjected to cold working. The cold working may be accomplished in cycles, utilizing intervening solution anneals, provided that the final step of the cycle is a cold working step. After cold working, the alloy is aged to effect the desired precipitation of alloying elements throughout the alloy. Aging of the worked alloy may be performed utilizing temperatures of 250° to 500° C for ½ to 24 hours, preferred conditions for thermal treatments being set forth in the specific examples which follow. The extent of cold working will vary according to requirements for articles produced from the alloy. The alloy processing may also include short time recrystallization treatments utilized to result in reduced grain size in the alloy without affecting the homogeneity of the alloy.

The extent of the improvement in strength properties over the prior art presented by the alloys of the instant invention is demonstrated in the following examples.

EXAMPLE I

Two alloys having a nominal composition of 0.3 weight percent titanium, 0.4 weight percent antimony and, respectively, 0.2 and 0.5 weight percent chromium, balance copper, were processed according to the optimum processing defined in U.S. Pat. Nos. 3,773,505 and 3,832,241. This processing included casting the alloys, hot working the alloys at an elevated temperature below the melting point of the alloys (with a range of from about 1500° to 1750° F or 815.5° to 954.4° C being preferred). After hot working, the alloys were rapidly cooled and then were cold rolled to a reduction of 75%, aged at 800° F (426.7° C) for 2 hours, cold rolled again to a reduction of 60% and finally aged at 700° F (371.1° C) for 1 hour. The properties of the alloys along with the properties of the alloy utilized in said patents (from Table V of each patent) are indicated in Table I.

TABLE I

Comparison of Cu-Ti-Sb-Cr Alloy Properties to Cu-Ti-Sb Alloy Properties Using Same Processing

| Alloy Composition | UTS (ksi) | 0.2% YS (ksi) | Electrical Conductivity (% IACS) |
|---|---|---|---|
| Cu-0.3 Ti-0.4 Sb-0.2 Cr | 91 | 88 | 71 |
| Cu-0.3 Ti-0.4 Sb-0.5 Cr | 96 | 94.5 | 66 |
| Cu-0.33 Ti-0.42 Sb | 87 | 79.2* | 75 |

*Measured at 0.1% YS.

The values presented in Table 1 indicate that the alloys of the present invention, particularly at the higher end of the chromium range, exhibit clearly superior strength when compared to the alloys of U.S. Pat. Nos. 3,773,505 and 3,832,241 albeit at conductivity ranges below those exhibited by the patented alloys.

EXAMPLE II

The two alloys incorporating chromium, identified in Example I, and a ternary alloy within the patent composition range described in Example I were processed according to the following procedure. All alloys were hot rolled, subjected to a 950° C solution anneal for 1 hour, rapidly cooled to maintain the maximum solid solution of all alloying elements, cold rolled to a 50% reduction, aged at 450° C for 4 hours, cold rolled to a 60% reduction and finally aged at 350° C for 1 hour. The properties obtained for each alloy are indicated in Table II. For additional comparative purposes, the strength values achieved by the patent ternary system, via processing defined in Table III of each patent at similar conductivity values are also included in Table II.

TABLE II

Comparison of Cu-Ti-Sb-Cr Alloy Properties to Cu-Ti-Sb Alloy Properties Using Same Processing And Different Patent Process

| Alloy Composition | UTS (ksi) | 0.2% YS (ksi) | Electrical Conductivity (% IACS) |
|---|---|---|---|
| Cu-0.3 Ti-0.4 Sb-0.2 Cr | 86 | 83 | 76 |
| Cu-0.3 Ti-0.4 Sb-0.5 Cr | 92 | 89 | 72 |
| Cu-0.3 Ti-0.4 Sb | 79.5 | 75 | 76 |
| Cu-(0.30–0.43) Ti- | | | |

TABLE II-continued

Comparison of Cu-Ti-Sb-Cr Alloy Properties to Cu-Ti-Sb Alloy Properties Using Same Processing And Different Patent Process

| Alloy Composition | UTS (ksi) | 0.2% YS (ksi) | Electrical Conductivity (% IACS) |
|---|---|---|---|
| (0.56–0.61) Sb* | 80.2 | 78.5 | 75.2 |

*processed according to Table III of U.S. Patents 3,773,505 and 3,832,241, YS measured at 0.5% offset.

The values presented in Table II indicated that the alloys of the present invention exhibit clearly superior strength compared to the alloys of U.S. Pat. Nos. 3,773,505 and 3,832,241 at the electrical conductivity range of 72–76% IACS, when all alloys are processed according to the present invention. The combination of the chromium addition and the processing of the present invention, when compared to the optimum processing of the prior art alloys, provides the final alloys with a significant increase in strength properties without reducing the electrical conductivity thereof in the process.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A high conductivity and high strength copper base alloy consisting essentially of 0.08 to 1.0% by weight titanium, 0.05 to 1.5% by weight antimony, 0.1 to 1.0% by weight chromium, balance copper, wherein the titanium and antimony are present at an atomic ratio of not more than 10% above 5 atoms of titanium per 3 atoms of antimony.

2. An alloy according to claim 1, wherein the titanium and antimony are present at an atomic ratio of 3 to 3.6 atoms of antimony per 5 atoms of titanium.

3. An alloy according to claim 1, wherein the chromium is present in the alloy in an amount form 0.1 to 0.6% by weight.

4. A process for producing a high conductivity and high strength copper base alloy comprising the steps of preparing a molten alloy consisting essentially of 0.08 to 1.0% by weight titanium, 0.05 to 1.5% by weight antimony, 0.1 to 1.0% by weight chromium, balance copper, wherein said titanium and antimony are present in the alloy at an atomic ratio of not more than 10% above 5 atoms of titanium per 3 atoms of antimony, casting said alloy, mechanically reducing the cross-section of the cast alloy by hot working andd subsequent cold working of the alloy, and subjecting the alloy to an aging treatment at 250° to 500° C for ½ to 24 hours.

5. A process according to claim 4, wherein the titanium and antimony are present at an atomic ratio of 3 to 3.6 atoms of antimony per 5 atoms of titanium.

6. A process according to claim 4, wherein said hot working is performed at a temperature high enough to perform a solution annealing function on the worked alloy and the annealed alloy is rapidly cooled to maintain the maximum solid solution of all alloying elements before said alloy is cold worked.

7. A process according to claim 4, wherein said alloy is solution annealed subsequent to hot working and rapidly cooled to maintain the maximum solid solution of all alloy elements before being cold worked.

8. A process according to claim 4, wherein said cold working is accomplished in cycles with solution annealing, provided that the final step of the cycles is a cold working step.

* * * * *